United States Patent [19]

Adams

[11] 4,029,439

[45] June 14, 1977

[54] CONTROL SYSTEM FOR VARIABLE DISPLACEMENT PUMPS

[75] Inventor: Cecil E. Adams, Columbus, Ohio

[73] Assignee: Abex Corporation, New York, N.Y.

[22] Filed: Dec. 22, 1975

[21] Appl. No.: 642,868

[52] U.S. Cl. ..... 417/216; 60/428; 60/449

[51] Int. Cl.[2] ..... F15D 31/02; F04B 49/00; F04B 1/26

[58] Field of Search ..... 417/216, 218, 222; 60/428, 429, 443, 449

[56] References Cited

UNITED STATES PATENTS

| | | | |
|---|---|---|---|
| 3,649,134 | 3/1972 | Wagenseil | 417/216 |
| 3,695,783 | 10/1972 | Soyland et al. | 417/216 |
| 3,732,036 | 5/1973 | Busbey et al. | 417/216 |
| 3,841,795 | 10/1974 | Ferre et al. | 417/216 |
| 3,891,354 | 6/1975 | Bosch | 417/216 |
| 3,908,519 | 9/1975 | Born et al. | 417/222 |
| 3,963,378 | 6/1976 | McMillan | 60/428 |

*Primary Examiner*—Carlton R. Croyle
*Assistant Examiner*—G. P. La Pointe
*Attorney, Agent, or Firm*—Thomas S. Baker, Jr.; David A. Greenlee

[57] ABSTRACT

In a hydraulic system having a plurality of variable displacement pumps driven by a prime mover, each pump has a variable ratio input device connected to a load sensing means. Each variable ratio input device automatically reduces the displacement of its respective pump by the same proportion when the prime mover is overloaded irrespective of the displacement setting of the pump and automatically increases the displacement of its pump by the same proportion up to the set displacement when the prime mover is not overloaded.

7 Claims, 9 Drawing Figures

Fig. 4
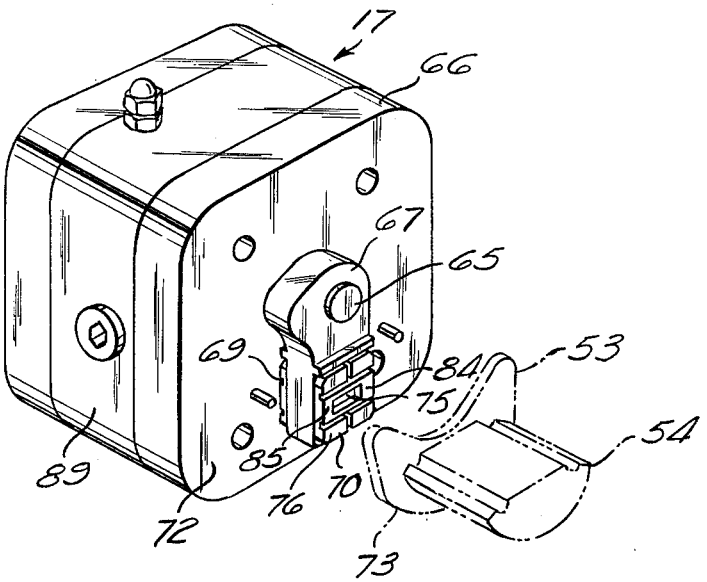
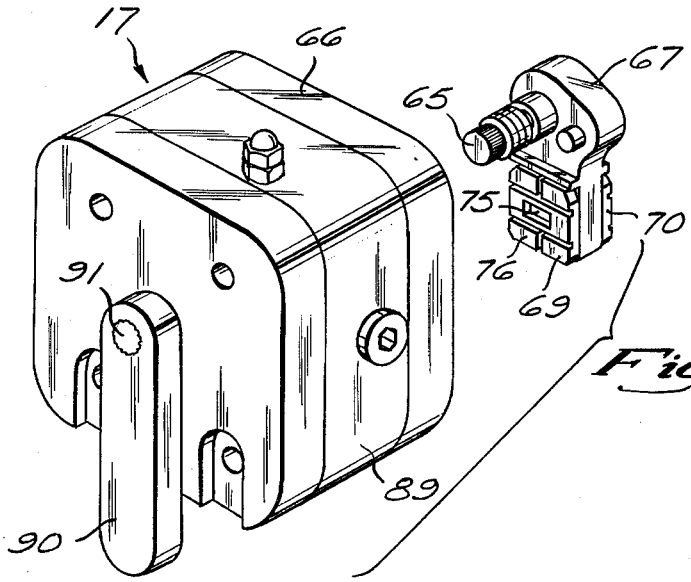
Fig. 5

Fig. 7
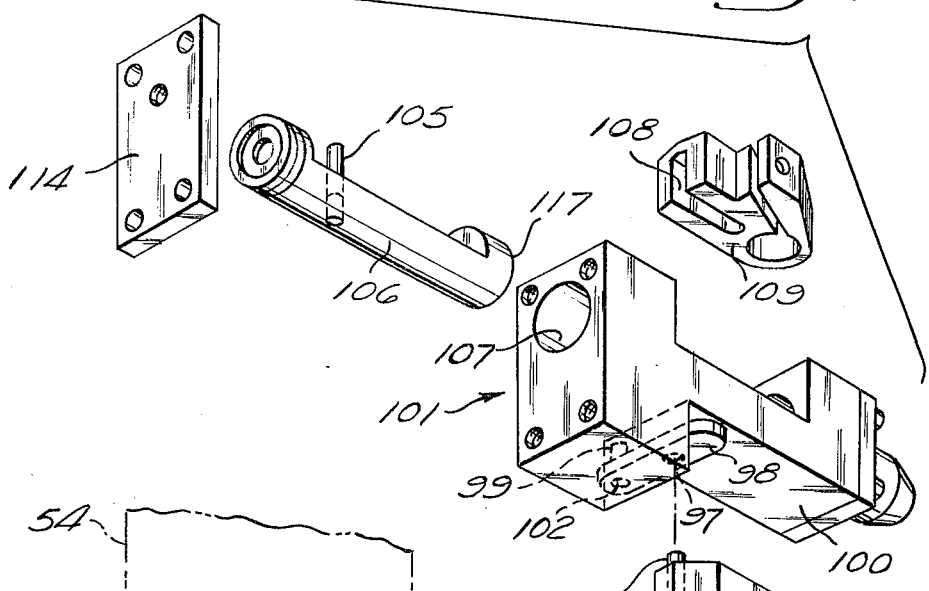
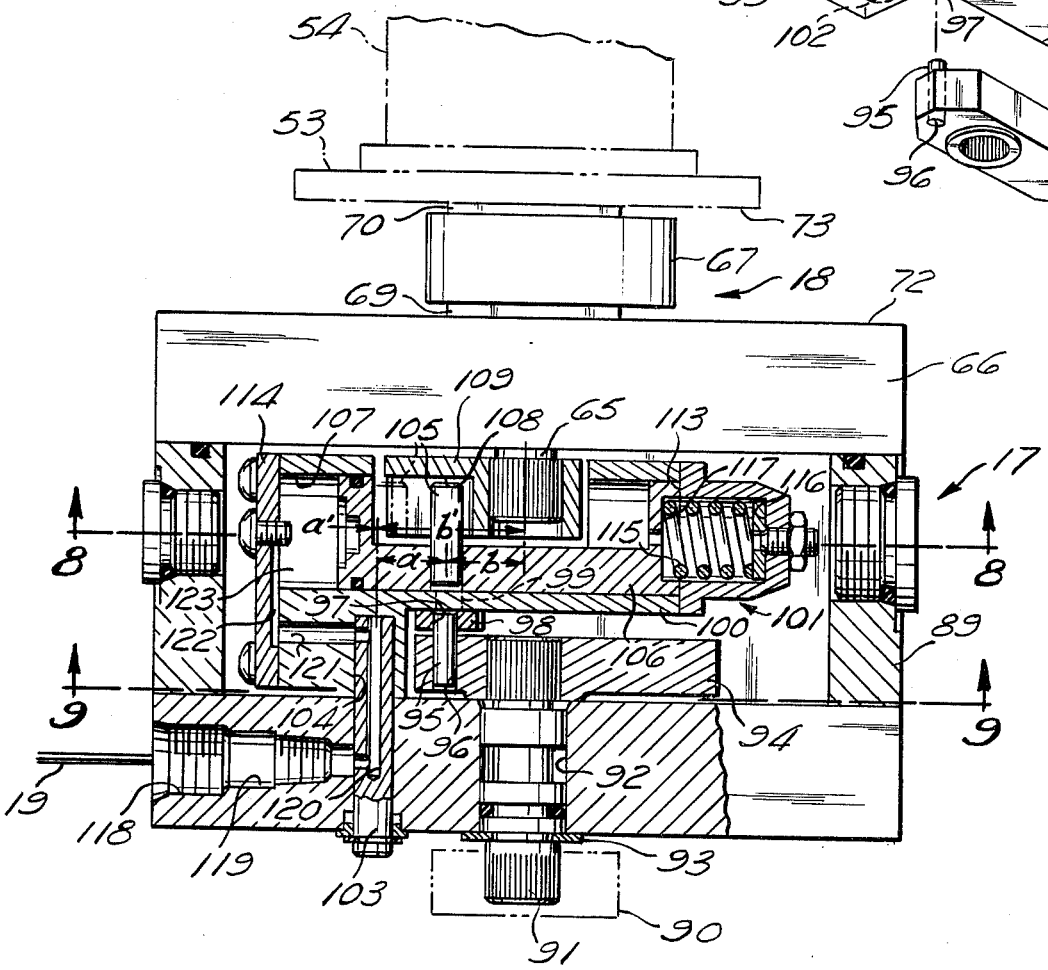
Fig. 6

Fig. 8
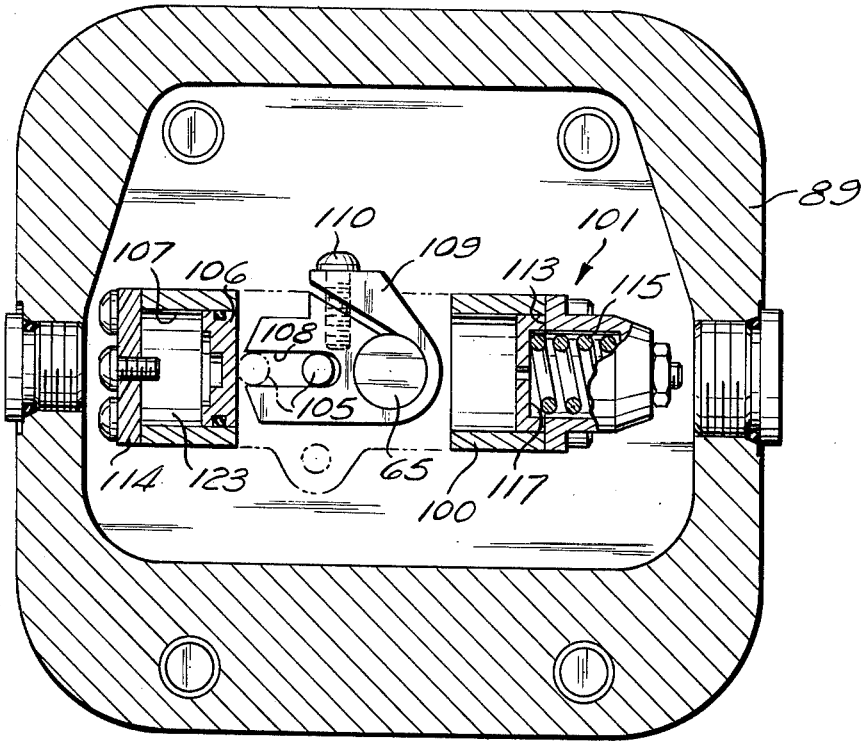
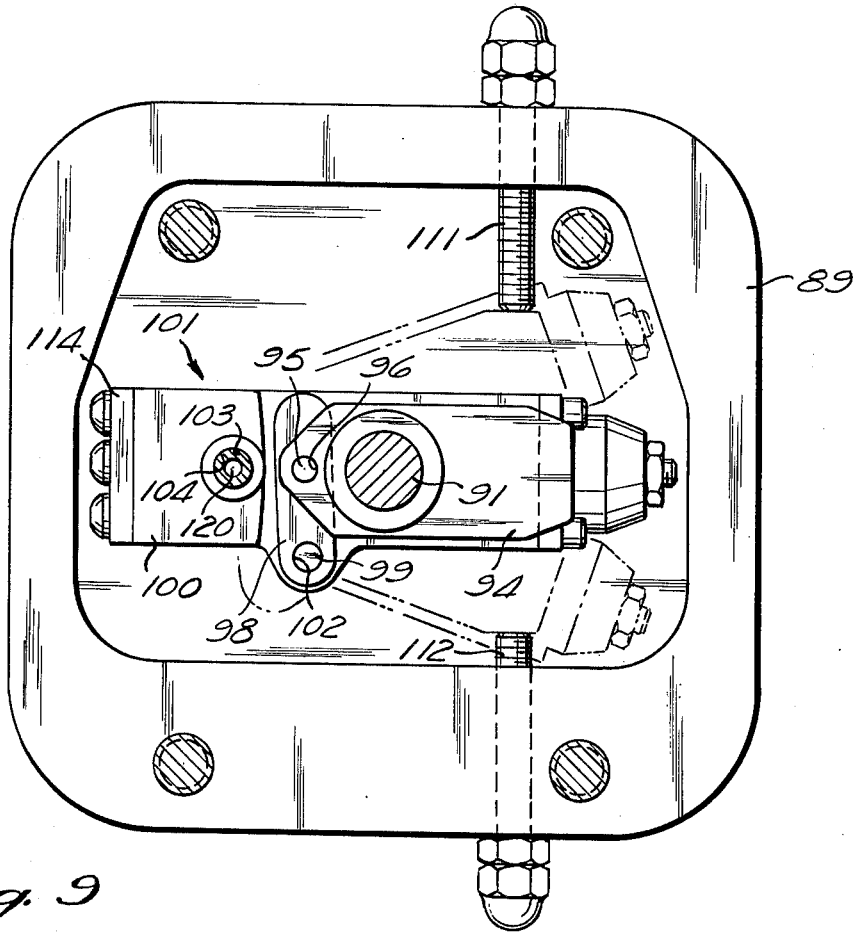
Fig. 9

CONTROL SYSTEM FOR VARIABLE DISPLACEMENT PUMPS

BACKGROUND OF THE INVENTION

I. Field of Invention

The instant invention relates to a control system for automatically adjusting the displacement of a plurality of variable displacement pumps which are driven by a prime mover.

II. Description of the Prior Art

It is common for a prime mover to drive a plurality of variable displacement pumps which are capable of demanding and using more horsepower than the prime mover can provide. As a minimum requirement, it is necessary to provide a control system which will act to reduce the displacement of some or all of the pumps when the prime mover approaches an overloaded condition in order to prevent it from stalling. Such control systems are well known.

In one control system, shown in U.S. Pat. No. 3,723,026 to Soyland, the collective pump working pressures exert a force on a valve. If the force exceeds a predetermined value the valve passes pressure fluid to the pilot stages of valves which operate to disconnect one or more constant volume pumps or to control pistons which operate to reduce the displacement of one or more variable displacement pumps.

In another control system, shown in U.S. Pat. No. 3,841,795 to Ferre et al, a fixed displacement pump driven by a prime mover, which also drives a plurality of variable displacement pumps, supplies fluid to an underspeed control valve. When the prime mover begins to slow down from overloading, the underspeed valve shifts to pass pressure fluid from the fixed displacement pump to servo-control valves which set the displacement of variable displacement pumps. These valves reduce the displacement of the pumps until the overload is eliminated.

A third control system, shown in U.S. Pat. No. 3,649,134 to Wagenseil, discloses a plurality of variable displacement pumps driven by a prime mover which drives a centrifugal governor. When the speed of the prime mover decreases due to overloading, the governor operates a valve which passes working pressure fluid from one of the pumps to spring biased pistons which reduce the displacement of the pumps.

Although the prior art control systems act to prevent the prime mover from stalling they do not change the displacement of all the variable displacement pumps proportionally. It is desirable to have a system which changes the displacement of all variable displacement pumps proportionally (i.e. the displacements of all of the pumps are reduced in proportion to the setting of the individual manual displacement controls) so that the speeds of all of the consumers are diminished proportionally when the prime mover is overloaded. Such a system is essential, for example, when two pumps driven by a prime mover drive fluid motors on opposite tracks of a tracklaying vehicle. If one track is in mud and the other is on hard ground, the pump supplying the motor of the former must displace more fluid thereto in order to keep the vehicle moving in a straight line. If the prime mover becomes overloaded, the displacements of the two pumps have to be reduced proportionally (by the same percentage) in order that the proportions of their fluid flows will remain constant and the vehicle will continue in a straight line.

In Soyland and Wagenseil, mentioned above, a control valve passes pressure fluid to spring biased control pistons when the prime mover is overloaded. The pistons are connected to the displacement varying mechanisms of the pumps and operate against the springs to reduce the displacement of the pumps. With this arrangement, if the pump displacements are different, they cannot be reduced uniformly by the same percentage. This is because when the pumps are at different displacements the spring forces on the control pistons are different. Consequently, when pressure fluid acts on the pistons, the one with the least spring force exerted thereon will move first and the displacement of its pump will be reduced disproportionally with respect to the other pumps.

SUMMARY OF THE INVENTION

The instant invention provides a control system for a plurality of manually adjustable variable displacement pumps driven by a prime mover which automatically reduces the set displacement of all pumps in a substantially proportional (by approximately the same percentage) manner regardless of their relative displacement when the prime mover becomes overloaded. When the overload condition ceases, the pump displacements are increased proportionally until the set displacement of each pump is reached.

In the instant control system, a prime mover drives a plurality of variable displacement pumps and a constant volume pump having signal pressure output which changes in proportion to the load on the prime mover. Each variable displacement pump has an independent control for selectively setting the displacement of the pump. The signal pressure output is connected to each independent control. Each control responds to the signal pressure output to proportionally change the displacement of each pump independently of its set displacement.

DESCRIPTION OF THE DRAWINGS

FIG. 4 is a perspective view of the input arm for the rotary servo control valve shown in FIG. 3 and the housing for a variable ratio rotary input device.

FIG. 5 is a perspective view showing the opposite side of the input arm shown in FIG. 4 and the housing for the variable ratio rotary input device.

FIG. 6 is a plan view of the variable ratio rotary input device and the input arm for the rotary servo control valve.

FIG. 7 is a exploded view of the variable ratio rotary input device.

FIG. 8 is an axial section view along line 8—8 in FIG. 6.

FIG. 9 is a view along line 9—9 in FIG. 6.

DESCRIPTION OF THE PREFERRED EMBODIMENT

Figure 1:
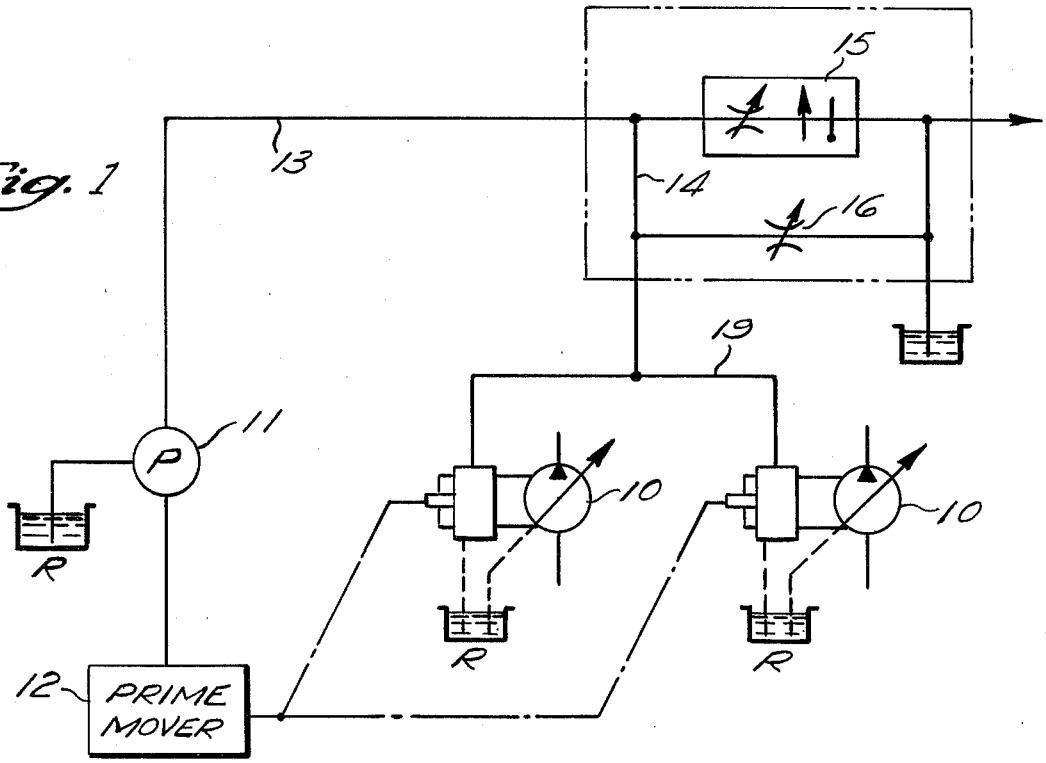
FIG. 1 is a schematic of a hydraulic system incorporating the instant invention.

The instant control system, shown in FIG. 1, comprises a plurality of manually adjustable variable displacement pumps 10 and a constant pump 11 all driven by a prime mover 12 which runs at a constant set speed. Each of the variable displacement pumps 10 draws fluid from a reservoir R and supplies it to a consumer such as a hydraulic motor, not shown.

In the instant control system, pump 11 draws fluid from reservoir R and passes pressure fluid through lines 13 and 14 to parallel connected pressure compensated flow control valve 15 and adjustable orifice 16. Flow control valve 15 is set to pass a fixed volume of fluid displaced by pump 11 to reservoir R for all pump displacements above a set minimum. The remainder of the pressure fluid from pump 11 passes through adjustable orifice 16 and creates a signal pressure upstream of orifice 16. When the speed of prime mover 12 drops because of an overload, the consequent drop in output of pump 11 reduces the volume of fluid supplied to orifice 16 which reduces the signal pressure. Likewise, when the overload is removed from prime mover 12 its increase in speed restores the output of pump 11 and increases the signal pressure.

An input device 17 is operatively connected to a pump servo control valve 18 to change the displacement of each pump 10 in response to a signal pressure change sensed via lines 14, 19 as described below. Valve 15 is sized such that a large percentage of the fluid displaced by pump 11 passes through the valve 15 and a small percentage through orifice 16 so that a relatively small change in the output of pump 11 creates a relatively large pressure change across valve 16 and hence provides a strong pressure signal to input device 17.

Referring to FIGS. 2–7, pump 10 is an axial piston type which has a case 20. Case 20 has a cavity 21 which receives a rotatable cylinder barrel 22 mounted on rollers 23 of a bearing 24 which has an outer race 25 pressed against a case shoulder 26. A drive shaft 27 which is rotatably supported in a bearing at the left side of case 20, not shown, has one end which projects from the case and is connected to the prime mover 12. The other end 28 of drive shaft 27 is splined to a central bore 29 in barrel 22.

Barrel 22 has a plurality of parallel bores 30 each having a sleeve 31 which contains a piston 32. Each piston 32 has a ball-shaped head 33 received in a socket 34 of a shoe 35.

The shoes 35 are retained against a flat creep or thrust plate 36 mounted on a movable rocket cam 37 by a shoe retainer assembly, not shown. Rocket cam 37 has an arcuate bearing surface 38 which is received in a complimentary surface 39 formed on rocker cam support 40 mounted in case 20. Rocker cam 37 is pivoted about a fixed axis perpendicular to the axis of rotation of barrel 22 by a pair of fluid motors to change pump displacement. If thrust plate 36 is inclined from a neutral position, normal to the axis of shaft 27 and cylinder barrel 22 is rotated, pistons 32 will reciprocate as shoes 35 slide over plate 36 to thereby pump fluid.

The displacement control mechanism of pump 10 will next be described. The mechanism on each side of rocker cam 37 is substantially the same. Thus, the description will refer to the left side shown in FIGS. 2 and 3 and identical elements on the right side of rocker cam 37 will be indicated by identical primed numbers.

Each fluid motor includes a vane or motor member 41 formed integrally on the side of the rocker cam 37 and movable therewith. Vane 41 extends beyond bearing surface 38 to overlie side 42 of rocker cam support 40 so that the center of vane 41 is at surface 38. Vane 41 has a central slot 43 which receives a seal assembly 44.

A vane housing 45 is located on rocket cam support 40 by dowel pins 46 and is attached to support 40 by bolts 47. One half of vane housing 45 overlies rocker cam 37 so that vane 41 is received in an arcuate chamber 48 which is closed by a cover 49 that is secured by bolts 47 to housing 45. As thus assembled, vane 41 and its seal assembly 44 divide chamber 48 into a pair of expansible fluid chambers 50, 50′, shown in FIG. 2, to form a fluid motor.

Fluid chambers 50, 50′ in the fluid motor on one side of rocker cam 37 are connected by passages 51, 52 to fluid chambers in an identical fluid motor located on the other side of rocker cam 37. Consequently, both motors are operated simultaneously by supplying pressurized fluid to one of the chambers 50, 50′ and exhausting fluid from the other chamber to move vane 41 within chamber 48.

The operation of the fluid motor is controlled by the rotary servo or follow-up control valve 18 which regulates the supply of pressurized fluid to fluid chambers 50, 50′. Rotary servo control valve 18 includes a fluid receiving valve assembly comprising a valve plate 53 and a stem 54 which are mounted on rocker cam 37 by double threaded bolts 55. The fluid receiving valve assembly and vane 41 move along concentric arcuate paths when rocker cam 37 is moved.

Valve plate 53 has a pair of ports 56, 57 which are connected to the respective fluid chambers 50′, 50. Port 56 is connected to fluid chamber 50′ through a bore 58 in stem 54, a fluid passage 59 in cam 37 and a bore 60 in vane 41 which opens into chamber 50′. Similarly, port 57 is connected to fluid chamber 50 through a bore 61 in stem 54, a fluid passage 62 in cam 37 and a bore 63 in vane 41 which opens into chamber 50.

Figure 2:
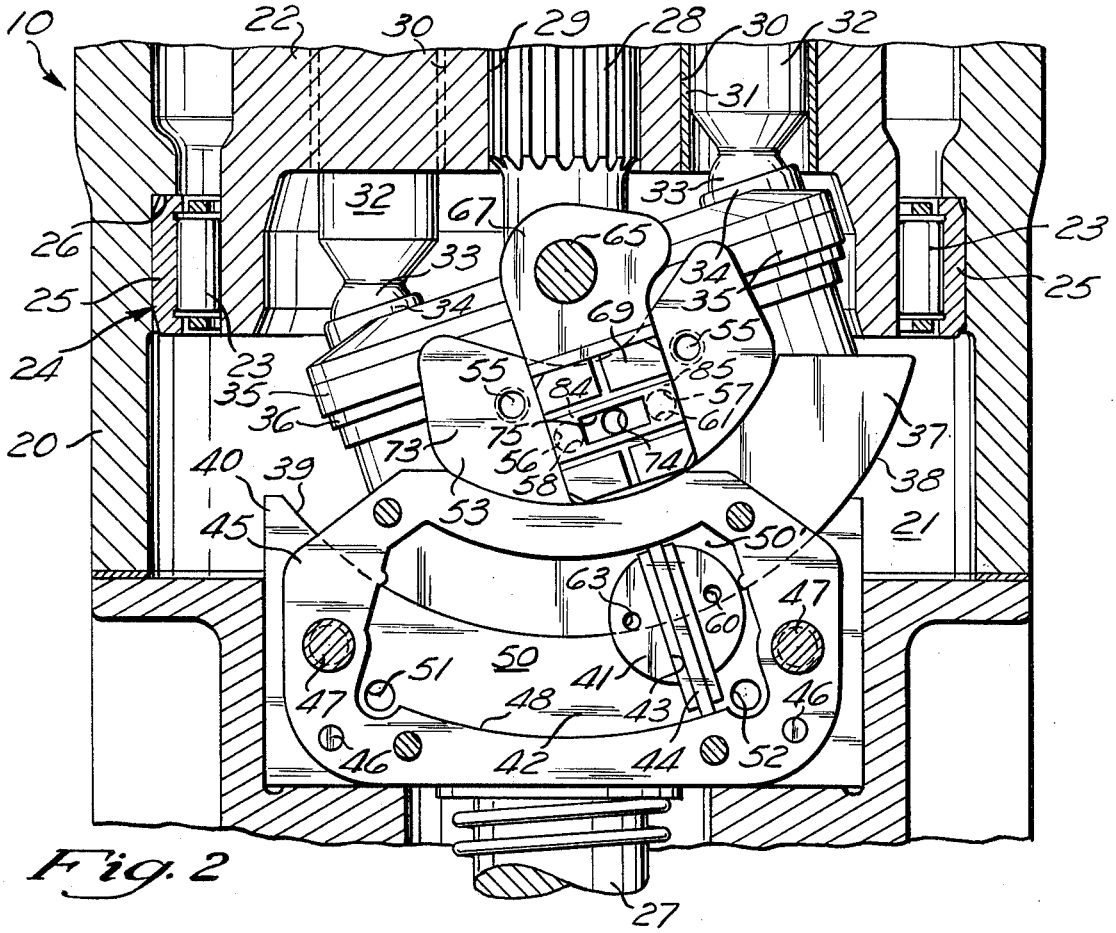
FIG. 2 is a partially broken away view of one of the manually adjustable variable displacements pumps shown in FIG. 1 showing the details of a displacement changing mechanism.

For counterclockwise operation of the fluid motor, as viewed in FIG. 2, pressure fluid is supplied to port 57 and flows into chamber 50 to move vane 41 and cam 37 counterclockwise. Expansion of chamber 50 causes chamber 50′ to contract and exhaust fluid into bore 60 and out of port 56 into the pump casing.

For clockwise operation of the fluid motor, the fluid flow is reversed. Pressure fluid is supplied to port 56 and expands chamber 50′ to move vane 41 and rocker cam 37 clockwise. Chamber 50 contracts and fluid exhausts through bore 63 and port 57 into the pump casing.

Referring again to FIGS. 2–5, that portion of rotary servo control valve 18 which selectively supplies fluid to the ports 56, 57 in valve plate 53 will now be described. An input valve assembly 64 includes a rotary input shaft 65 mounted in a cover plate 66. Cover plate 66 is attached to case 20 by bolts and includes a fluid port, not shown, which receives servo fluid from a source, not shown. An input arm 67 is fastened to the inner end of shaft 65 and moves on a roller bearing 68 sandwiched between arm 67 and cover plate 66.

Input valve assembly 64 also includes a pair of identical valve shoes 69, 70 which are received in a bore 71 in arm 67. Arm 67 pivots about the same axis as valve plate 53. When shaft 65 is rotated and arm 67 moves, shoe 69 rides on a flat inner surface 72 of cover plate 66 and shoe 70 rides on a flat surface 73 of valve plate 53. Each shoe 69, 70 is continuously fed servo fluid from the port in the cover plate through a central fluid receiving bore 74 to a rectangular cavity 75 which opens into a flat bottom face 76. The length of rectangular cavity 75 is equal to the distance between ports 56, 57 and cavity 75 moves along the same arc as ports 56, 57.

O-rings 77, 78 seated on shoulders 79, 80 of respective shoes 69, 70 prevent fluid leakage out of bore 74 and radially position the shoes 69, 70 in bore 71 when under pressure. A pair of flat washers 81, 82 which are urged apart by a spring washer 83 bias O-rings 77, 78 against respective shoulders 79, 80 and shoes 69, 70 against respective flat surfaces 72, 73.

The operation of manually setting the displacement of pump 10 by operation of the rotary servo control valve 18 is as follows. To manually set the displacement of pump 10, rotary input shaft 65 is rotated in the direction rocker cam 37 is to pivot. Rotation of input shaft 65 clockwise, as viewed in FIG. 2, moves shoe 70 clockwise and aligns cavity 75 with port 56, while uncovering port 57. Servo pressure fluid flows from cavity 75 into port 56, and then into chamber 50' as described above. Simultaneously, fluid exhausts from chamber 50 out of uncovered port 57 and rocker cam 37 pivots clockwise as described above. Rocker cam 37 is pivoted counterclockwise in a similar manner if rotary input shaft 65 is rotated counterclockwise to align cavity 75 with port 57. Rocker cam 37 is pivotable between a position of maximum fluid displacement in one direction through a neutral or minimum fluid displacement position to a position of maximum fluid displacement in the other direction.

Accurate follow-up is provided since angular movement of rocker cam 37 and valve plate 53 is equal to that of rotary input shaft 65. When rocker cam 37 and valve plate 53 have moved through the same angle as input shaft 65, cavity 75 in shoe 70 is again centered between ports 56, 57, flats 84, 85 on shoe 70, cover ports 56, 57 and the fluid motors stop.

Figure 3:
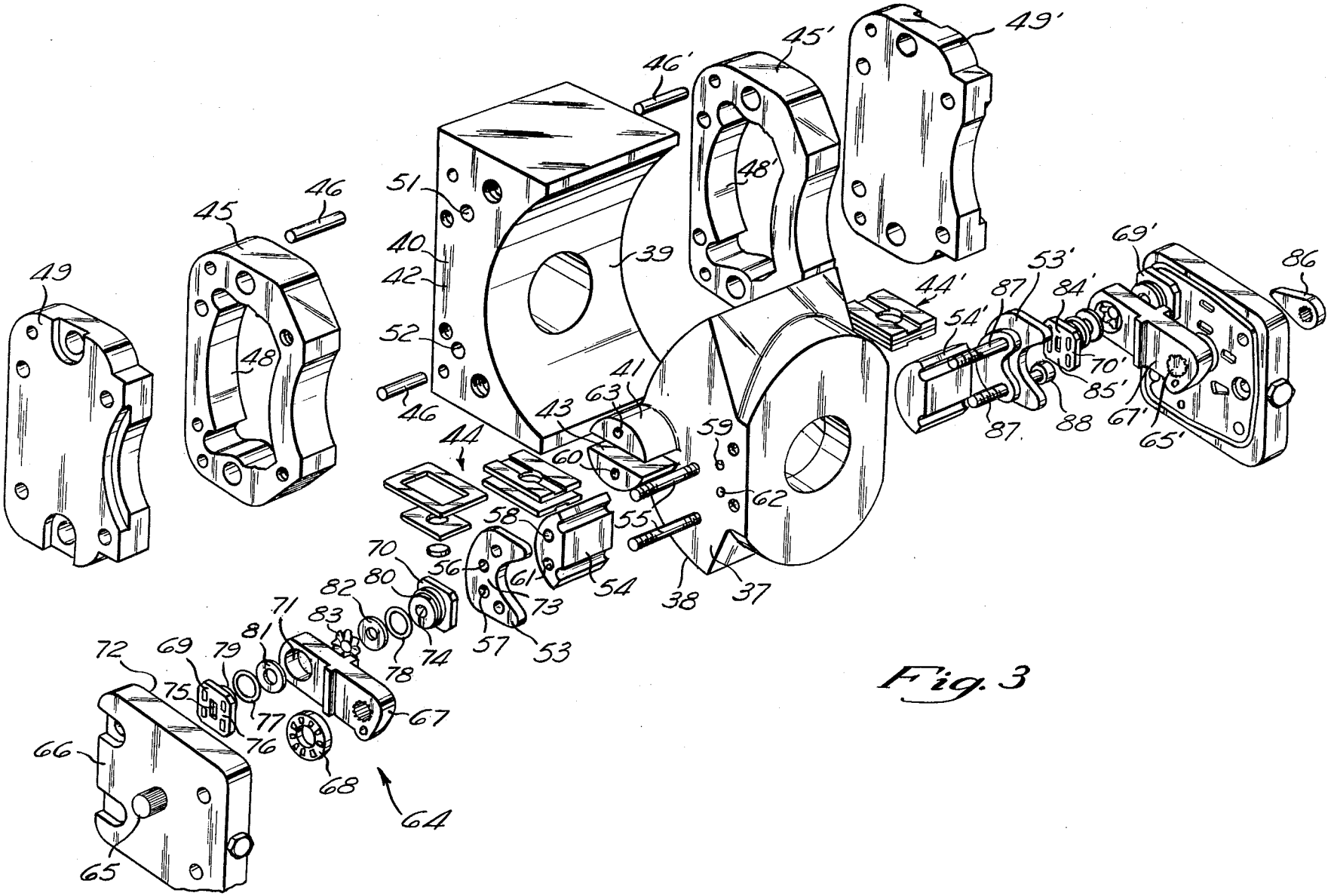
FIG. 3 is an exploded view of the displacement changing mechanism shown in FIG. 2.

The mechanism on the right side of rocker cam 37 shown in FIG. 3 has a pointer 86 on the end of shaft 65'. Bolts 87 which secure valve plate 53' and stem 54' to rocker cam 37 have heads 88 which capture valve shoe 70' and arm 67' and force the arm to move when cam 37 is moved. This moves pointer 86 to indicate the exact angular position of rocker cam 37.

In the instant control system each of the variable displacement pumps 10 has a variable ratio rotary input device 17 mounted in cooperation with rotary input shaft 65 of servo control valve 18. As previously mentioned, rotary input device 17 is connected to signal pressure and operates in response to changes in the load condition of prime mover 12. Rotary input device 17 operates to automatically reduce the displacement of pump 10 from the manually set amount when prime mover 12 is overloaded and increases the displacement of pump 10 up to the manually set amount whenever prime mover 12 is not at its maximum load.

Referring to FIGS. 6–9, rotary input device 17 comprises a housing 89 which overlies rotary input shaft 65 and is attached to cover plate 66 by bolts, not shown. A control lever 90 is attached to one end of a control shaft 91 which is mounted in a bore 92 in housing 89 in axial alignment with shaft 65. Control shaft 91 is retained in housing 89 by a spring clip 93. An arm 94 is rigidly affixed to the other end of shaft 91. A pin 95 pressed into a bore 96 in arm 94 is pivotally mounted in a bore 97 in one end of a link 98. A second pin 99 which has one end pressed into a housing 100 of a piston assembly 101 has its other end pivotally mounted in a bore 102 in the other end of link 98. Piston assembly 101 is rigidly affixed to a shaft 103 which is pivotally mounted in a bore 104 in housing 89. By this arrangement when shaft 91 is manually rotated in one direction, piston assembly 101 rotates in the opposite direction with shaft 103. Pins 95, 99 and link 98 are arranged so that assembly 101 rotates the same number of degrees as shaft 91.

Piston assembly 101 is connected to rotary input shaft 65 through a pin 105 which has one end pressed into a slidable piston 106 mounted in a bore 107 in assembly 101 and has the other end engaged in a slot 108 in an input arm 109 which is rigidly clamped to shaft 65 by a bolt 110. When piston assembly 101 pivots in one direction with shaft 103 pin 105 rotates input arm 109 about shaft 65 in the opposite direction. Therefore, when shaft 91 is rotated input shaft 65 is rotated in the same direction to operate rotary servo control valve 18 to set the displacement of pump 10.

Shaft 91 is rotatable between a first position in which arm 94 engages a stop pin 111 and a second position in which arm 94 engages a stop pin 112. Shaft 65 is centered and set to provide minimum pump displacement when arm 94 is centered between stop pins 111, 112 as shown in FIGS. 8 and 9. In normal operation, the first position of shaft 91 pivots input shaft 65 approximately 19° from center to provide maximum pump displacement in one direction and the second position of shaft 91 pivots input shaft 65 approximately 19° from center to provide maximum pump displacement in the other direction.

Horizontal movement of pin 105 changes the ratio between rotational movement of control shaft 91 and input shaft 65. During normal operation, piston 106 is at the right against wall stop 113 and pin 105 is equidistance between shaft 65 and shaft 103 when shaft 65 is in the maximum pump displacement position. Since, distance *a*, between pin 105 and shaft 103, is fixed while distance *b*, between pin 105 and shaft 65, changes a small amount as shaft 65 is rotated, the rotation of input shaft 65 is not exactly equal to that of shaft 91. However, because shaft 65 and input arm 109 only rotate a maximum of 19° from center, distance *b* changes very little and is substantially equal to distance *a*. Therefore, the ratio of rotation of shaft 65 to that of piston assembly 101 (which is opposite but equal to that of shaft 91) is practically 1:1 and rotation of control shaft 91 through piston assembly 101 will cause substantially (within 5–10%) equal rotation of shaft 65. In normal operation shaft 65 can be rotated by operation of control lever 90 and rotation of control shaft 91 to either maximum pump displacement position.

When prime mover 10 is overloaded, piston 106 is displaced to the left away from stop 113. If it is continuously overloaded, piston 106 is moved into contact with end cover 114 by a spring 115 acting between an end wall 116 and end 117 of piston 106. In this position of piston 106, pin 105 is at the outer end of slot 108 in arm 109, as shown in phantom in FIG. 6, and closer to shaft 103 than shaft 65. Consequently, distance *a'* will be less than distance *b'* and the rotation of shaft 65 will be less than that of control shaft 91. In the instant invention when pin 105 is at the end of slot 108 the ratio of movement of shaft 65 to that of shaft 91 is 1:10, i.e. shaft 65 is rotated one tenth of a degree for each degree shaft 91 is rotated. For example, when shaft 91 is rotated to maximum pump displacement position and arm 94 is against one of the stops 111, 112, approximately 19° from the center position between the stops 111, 112, shaft 65 is rotated approximately 1.9° to operate rotary servo valve 18 to set a small displacement of pump 10.

When piston 106 is displaced between stop 113 and cover 114, rotation of control shaft 91 will cause a rotation of shaft 65 proportionally less than that of shaft 91 depending upon how far piston 106 is displaced from stop 113.

Operation of variable ratio rotary input device 17 under normal operating conditions can best be seen by referring to FIG. 6. Under normal operating conditions signal pressure fluid from line 19 enters port 118 and flows through bore 119, bore 120 in shaft 103, fluid passage 121 in piston assembly 101 and passage 122 into an expansible fluid chamber 123 and biases piston 106 to the right, against the opposition of spring 115, into abutment with wall stop 113. Since, as previously mentioned the ratio of rotation of shaft 65 to rotation of piston assembly 101 is 1:1 in this position of piston 106, rotation of control shaft 91 will cause an equal and corresponding rotation of shaft 65 to provide the set pump displacement.

Operation of variable ratio rotary input device to proportionally change the displacement of a plurality of pumps 10 when prime mover 12 is overloaded is as follows. When prime mover 12 is overloaded the pressure fluid signal acting on piston 106 in each device 17 is insufficient to overcome spring 115. Consequently, spring 115 moves piston 106 to the left to reduce pump displacement. Since the pistons 106 in all of the devices in a control system receive an identical signal pressure output they all move the same distance to the same location in cylinder bore 107 to reduce the displacement of the pumps 10. Consequently, the displacement of each pump 10 is reduced by substantially the same percentage regardless of the manual setting of input shaft 91. When prime mover 12 is no longer overloaded the signal pressure output is increased, the pistons 106 are moved to the right and the pumps 10 are returned to the set displacements.

It should be noted that the displacement of any pump 10 in the system can be changed manually at any time and the control system will automatically adjust the displacement of all the pumps 10 if the prime mover is overloaded or if an overload is reduced or eliminated. In this way the full power of prime mover 12 is always available to all pumps 10 in the system regardless of their displacements or working pressures.

Also, all pumps 10 can operate at their peak working pressures at all times since only the displacement of the pumps 10 is changed in the instant control system. This allows the pumps 10 to continue doing heavy work when prime mover 12 is overloaded. Only the rate of doing work is changed.

Obviously, those skilled in the art may make various changes in the details and arrangements of parts without departing from the scope of the invention.

I claim:

1. In a control for a hydraulic system which includes a prime mover, a plurality of variable displacement pumps driven thereby, each pump having a movable thrust plate, a fluid motor connected to the thrust plate which is operable to pivot the thrust plate between a position of maximum fluid displacement in one direction and a position of maximum fluid displacement in another direction and an independent control for selectively operating the fluid motor to move the thrust plate to thereby control the displacement of the pump, the improvement comprising a load sensing means, means connecting the load sensing means to the prime mover, the load sensing means having an output signal proportional to the load on the prime mover, each independent control including a rotary servo control valve which controls the fluid motor to selectively set the displacement of the pump, the rotary servo control valve having an input assembly which includes a rotary input shaft which sets the position of the fluid motor and the thrust plate to thereby set the displacement of the pump and the independent control further includes a variable ratio rotary input means connected to the rotary input shaft, second means connecting the variable ratio rotary input means to the output signal and the variable ratio rotary input means includes means for manually setting the position of the rotary input shaft to set the pump at a desired displacement and means responsive to said output signal for automatically changing the displacement of the pump in response to the output signal irrespective of the position of the manual setting means and each of said variable ratio rotary input means changes the displacement of its respective pump by the same percentage.

2. The control recited in claim 1, wherein the manual setting means includes a rotary control shaft, the responsive means includes a ratio changing device, and third means connecting the ratio changing device to the rotary control shaft and the rotary input shaft such that rotation of the control shaft causes rotation of the input shaft.

3. The control recited in claim 2, wherein the ratio changing device is movable between a first position in which the ratio of degrees of rotation between the rotary input shaft and the rotary control shaft is substantially 1:1 and the rotary input shaft moves to a position set by the control shaft to thereby adjust the displacement of the pump to the set position and a second position in which the ratio between the rotary input shaft and the control shaft is less than 1:1 such that the rotary input shaft moves less than the control shaft and the fluid motor moves the thrust plate to set the displacement of the pump to a position of lesser displacement than set by the control shaft.

4. The control recited in claim 2, wherein the rotary control shaft is positioned in axial alignment with the rotary input shaft.

5. The control recited in claim 3, wherein the ratio changing device includes a movable spring biased piston connected to the output signal, pressure fluid is supplied to the piston from the output signal and the pressure fluid moves the piston against the spring to put the ratio changing device in the first position when the prime mover is not overloaded and the spring moves the piston to put the ratio changing device in the second position when the prime mover is overloaded.

6. The control recited in claim 3, wherein the ratio changing device includes a pivotal assembly, fourth means connecting the piston assembly to the control shaft such that rotation of the control shaft causes the piston assembly to pivot approximately the same number of degrees and fifth means connecting the piston assembly to the rotary input shaft such that the input shaft rotates when the piston assembly pivots.

7. The control recited in claim 6, wherein the piston assembly includes a movable piston and the fifth connecting means includes a pin attached to the piston, an input arm with a longitudinal slot attached to the input shaft and the pin is engaged in the slot to connect the piston assembly and the input arm.

* * * * *

UNITED STATES PATENT OFFICE

CERTIFICATE OF CORRECTION

PATENT NO. : 4,029,439

DATED : June 14, 1977

INVENTOR(S) : Cecil E. Adams

It is certified that error appears in the above-identified patent and that said Letters Patent are hereby corrected as shown below:

Col. 3, line 32 - "Figs 2-7" should read --Figs. 2-4-- lines 47 & 48 - "rocket" should read --rocker--

Col. 4, line 3 - "rocket" should read --rocker--

Col. 8, line 55 - after "pivotal" insert --piston--
(Claim 6)

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*